United States Patent [19]

Frei

[11] 4,324,284

[45] Apr. 13, 1982

[54] VENETIAN BLIND

[75] Inventor: Paul Frei, Elgg, Switzerland

[73] Assignee: Griesser A. G., Switzerland

[21] Appl. No.: 119,501

[22] Filed: Feb. 7, 1980

[51] Int. Cl.[3] ..... E06B 9/30

[52] U.S. Cl. ..... 160/172; 160/178 F

[58] Field of Search ..... 160/172, 173, 178 R, 160/178 D, 178 E, 178 F, 34, 107, 176

[56] References Cited

U.S. PATENT DOCUMENTS

| | | | |
|---|---|---|---|
| 847,143 | 3/1907 | Wyss | 160/178 F |
| 3,651,852 | 3/1972 | Neri | 160/172 |
| 4,199,019 | 4/1980 | Frei | 160/172 |

*Primary Examiner*—C. J. Husar
*Assistant Examiner*—C. S. Lieberman
*Attorney, Agent, or Firm*—McGlew and Tuttle

[57] ABSTRACT

A venetian blind, comprises, a plurality of slats, with a pin extending from either side of each slat and a pair of casings having longitudinal slots for receiving the pins and permitting the longitudinal movement of the slats. The slats are connected by a collapsible ladder support which effects the pivoting of each of the slats as they are extended and retracted. A driven windup shaft is rotatably mounted on the casings and carries a draw member in the form of a chain thereon. An upper carriage part is connected to one end of the draw member. The upper carriage part has a stop surface which is abutable against an end stop to stop the movement of the draw member in one direction. A lower carriage part is slidably connected to the upper carriage part and connected to a lowermost one of the plurality of slats. A compression spring is connected between the upper and lower carriage parts for biasing them apart so that, when the slats are extended to their fullest extent, any overdrive of the windup shaft is absorbed by the spring.

9 Claims, 6 Drawing Figures

VENETIAN BLIND

FIELD AND BACKGROUND OF THE INVENTION

The present invention relates to venetian blind constructions in general and, in particular, to a new and useful venetian blind which utilizes a two-part carriage structure for supporting a lower one of a plurality of slats in a stack.

Such a venetian blind is disclosed in Swiss Pat. No. 565,935, for example. The draw member is usually an endless chain trained over a lower and an upper (driven) sprocket wheel and provided with an inserted intermediate piece which is guided in the casing, to which a supporting plate carrying an engaging member for the end pin of the lowermost slat is secured. This design has proven satisfactory in itself.

The conventional pivoting mechanism is readily responsive to the lowering or closing of the gathered blind, with the result that the slats which occupy a horizontal, open position in their gathered state are immediately pivoted into their almost vertical closing position. As soon as the blind is completely lowered or closed, all of the slats are closed. Since a reverse rotation of the windup shaft is necessary to open the slats, the blind is correspondingly lifted or opened due to the rigid connections between the lowermost slat and the draw member, which is undesirable.

Further, with a mechanical drive of the windup shaft and, consequently, of the draw member, it is difficult to set the motor to stop or be disengaged exactly upon reaching the lowermost end position. To ensure a complete lowering or lifting of the blind at any time, it is customary to insert a spring into the endless chain whose range of motion or action can absorb the inaccuracies of the motor setting. This of course can also be applied to designs wherein, as in the cited Swiss patent, means are associated with the pivoting mechanism for permitting only a limited pivoting of the slats during the lowering of the blind into a predetermined inclined position. That is, as soon as the blind with the inclined slats reaches its lower end position, the draw chain must continue its motion in the same direction, that is downwardly, to obtain a complete closure, which again can be effected only while using an intermediate spring. Such an intermediate spring, which is flexible in any direction, however, always makes the draw member relatively unstable, quite aside from the fact that, for example, an endless draw chain with an inserted intermediate spring is fairly expensive.

The present invention is directed to a venetian blind of the above specified kind which avoids the mentioned drawbacks and permits the use of a simple draw chain without an intermediate spring.

Accordingly, an object of the present invention is to provide a venetian blind, which comprises, a plurality of slats, with a pin extending from at least one side of each of said slats, a casing having a longitudinal slot for receiving each of said pins to permit longitudinal movement of the slats, collapsible support means interconnecting the plurality of slats for pivoting the slats as the slats are moved to extend and retract the venetian blind, a driven windup shaft rotatable on the casing, a draw member engaged with the windup shaft and movable in the casing by rotation of the shaft, an upper carriage part connected to one end of the draw member having a stop surface, an end stop on the casing against which the stop surface is abutable to stop movement of the draw member in one direction, a lower carriage part slidably connected to the upper carriage part and connected to a lowermost one of the slat pins, and spring means connected between the upper and lower carriage parts for biasing them apart, whereby, when the draw member is moved to extend the blind and is brought to a lowermost position of the lower carriage part, excess movement of the draw member is absorbed by the spring means.

The spring acting on the two carriage parts makes it possible to dispense with any additional intermediate spring in the draw member. Since the carriage reaches its lowermost position with its parts spread apart, a continued blind lowering movement of the draw member can only effect a further lowering and spring compressing motion of the upper carriage part, which motion may be utilized for pivoting the slats, for example, from their fully open or semi-open (inclined) position into their closing position, depending on which lowering position of the slats is provided.

A draw member design which has proved particularly advantageous is an open chain which is secured by one end to the upper carriage part, run over an upper sprocket wheel rotating with the windup shaft, and carries an end stop on its other end, limiting the lowering of the blind. Aside from the fact that the need for a lower sprocket wheel is eliminated, a substantial advantage of the inventive design is the shortness of this open chain requiring only a few chain links for securely engaging the upper sprocket wheel while the blind is lowered.

A further object of the present invention is to provide a venetian blind which is simple in design, rugged in construction and economical to manufacture.

For an understanding of the principles of the invention, reference is made to the following description of a typical embodiment thereof as illustrated in the accompanying drawings, in which, FIG. 1 is a vertical sectional view of a raised blind with gathered slats;

DESCRIPTION OF THE PREFERRED EMBODIMENT

Figure 1:
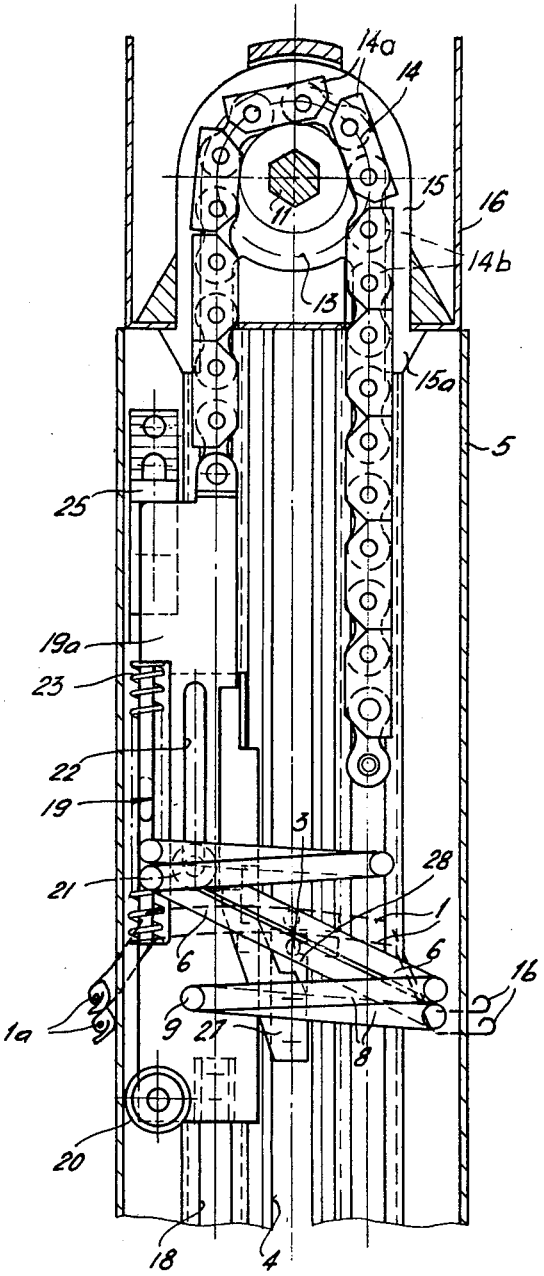

Turning to the drawings in particular, the invention embodied therein in FIG. 1, comprises, a venetian blind construction having a plurality of slats 1, only two of which are shown in a stacked or open position. The slats each include a pin 3 which is connected to a collapsible support unit having levers 6 and 8 with pivot points 9. The lowermost pin 3 of the lowermost slat 1 is connected to a carriage 19 which, in turn, is connected to a drive member 14 in the form of a chain which is carried on a sprocket wheel 13 which, in turn, is carried and driven by a shaft 11. To lower the blinds, the shaft 11 rotates in a counterclockwise direction, as shown in FIG. 1 which, in turn, lowers the carriage 19 and the lowermost pin 3 with slat 1 to extend the blind structure.

The inventive venetian blind comprises metal slats 1 having a multi-angled cross-section and flanged edges 1*a*, 1*b*, rolled downwardly in the front and upwardly in the rear. On both lateral edges of each slat 1, a pin 3 is fixed to the underside of the slat. Each pin 3 is guided, by means of plastic bushings 2, in a longitudinal slot 4 formed by the inside wall portions of a C-section casing 5. Each pin 3 is fixed, by its free end projecting into casing 5, to the center portion of a cross-lever 6.

On its opposite side remote from pin 3, each of the free end portions of cross-lever 6 carries a bolt 7*a*, 7*b*, respectively, extending parallel to the pin. Bolts 7*a* and 7*b* of every two consecutively mounted cross-levers 6 are connected to each other by toggle joints 8, so that an articulate ladder-like supporting structure collapsible about the knees or pivots of the joints is formed. This supporting structure is suspended from a windup shaft 11 of the blind, for example, by means of metal bands, cables or chains 10 (FIGS. 2, 3) which are attached by one of their ends to bolts 7*a*, 7*b* of the cross-lever 6 of the uppermost slat 1, and by their other end to a balance beam indicated at 12 and mounted on windup shaft 11. Windup shaft 11, which may be driven by a self-locking mechanism (crank handle or mechanical means) carries a sprocket wheel 13 on each of its ends, on which a single open chain which can flex only inwardly, is wrapped.

The draw member or chain 14 can flex only in one direction around the sprocket 13 due to the presence of chain plate members 14*a* which are connected between chain links 14*b* and prevent the flexing of chain 14 in any direction except around sprocket wheel 13. In the zone of sprocket wheel 13, the chain is surrounded by a guard 15 (FIG. 1), having its hook-like lower ends 15*a* engaged into bottom holes of the housing 16 supporting windup shaft 11. This prevents chain 14 from being lifted radially from sprocket wheel 13.

Both the chain strand running off sprocket wheel 13 and carrying a limiting stop 17 on its free end, and the chain strand running on the wheel (and connected to the lowermost slat 1 as will be explained hereinafter) are guided, with a relatively small amount of play, in a vertical guide 18 provided in casing 5. The chain is thus prevented from undesirable flexing. With a completely lowered blind and closed slats 1, the limit stop 17 provided on the trailing strand of the chain 14 rests on the bottom of housing 16 (FIG. 3), thus limiting the further drop of the blind. The end of the other strand of the chain is hinged to the upper part 19*a* of a two-part carriage 19 which is vertically movable and guided in casing 5.

The lower part 19*b* of carriage 19 is provided with a backup roller 20 for improved guidance. A vertical slot 22 which is provided in upper carriage part 19*a* and serves as a guide for a slide pin 21 of the lower carriage part 19*b*, makes possible a limited vertical motion of the two carriage parts 19*a* and 19*b* relative to each other. The two carriage parts 19*a* and 19*b* are permanently urged apart by a compression spring 23 disposed therebetween. The top shoulder 24 of upper carriage part 19*a* cooperates with a vertically adjustable stop 25 provided in casing 5, and thus limits the upper end position of the blind. Carriage 19 is guided by means of slide shoe 26, which is preferably made of plastic, in the guide 18 associated with the run-on chain strand.

A supporting plate 27 carrying an engaging member 28 is secured to the lower carriage part 19*b*. Pin 3 of the lowermost slat 1 is received in a notch 29 of engaging member 28, and the flat top side of member 28 serves as an abutment for the gathered slats.

The described elements of the blind cooperate as follows: As shown in FIG. 1, with a completely lifted or open blind, the upper carriage part 19*a* applies against top stop 25. Compression spring 23 holds carriage parts 19*a* and 19*b* in their spread apart positions, and the gathered pack of slats rests against engaging member 28. The end of the runoff strand of the chain 14 carrying stop 17 (not shown in FIG. 1) extends freely from the right side of sprocket wheel 13 and toward the bottom of the casing.

Figure 2:
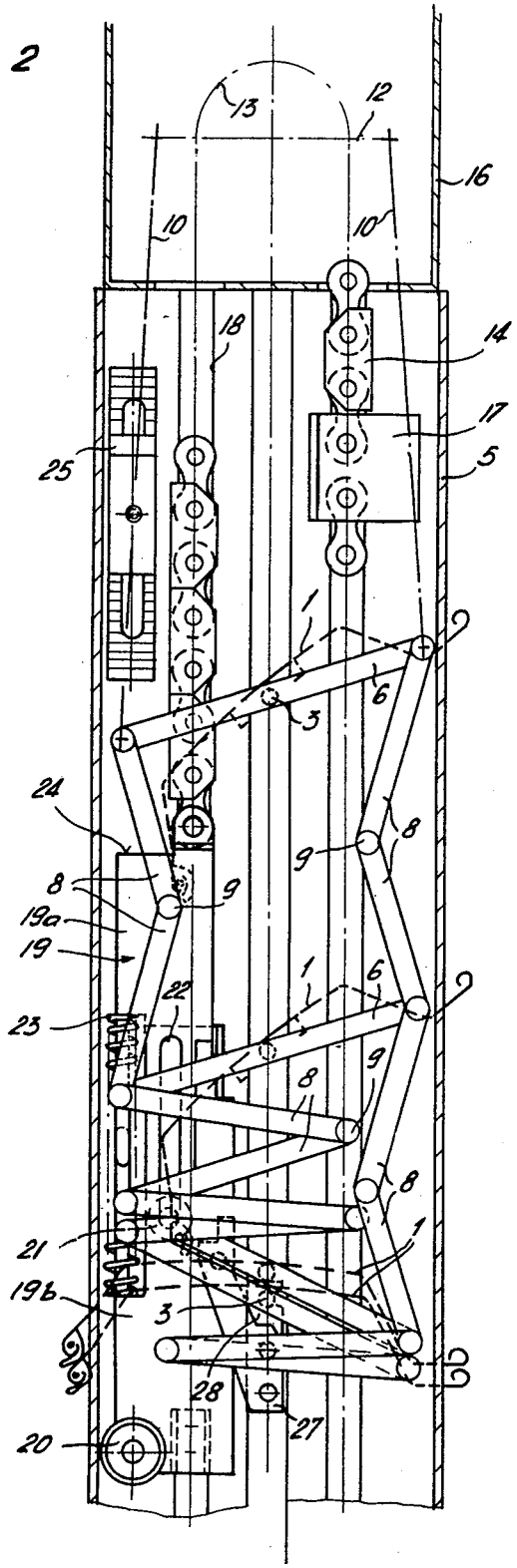
FIG. 2 is a view similar to FIG. 1 showing a partly lowered blind with the slats pivoted into a predetermined inclined position.

If the windup shaft 11 is now turned to the effect of lowering the blind (counterclockwise in FIG. 1), chain 14, through carriage 19, and engaging member 28, allows the slat pack to descend, during which motion, the toggle joints 8 by which the slats are linked to each other stretch one after the other, because the cross-lever 6 of the uppermost slat is attached at a fixed level, and the slats become, in succession, equi-distantly spaced from each other, (FIG. 2).

In this connection, it should be noted that during, and due to the rotation of windup shaft 11, the balance beam 12 of the pivoting mechanism, which is not described in more detail in this specification and may be designed in accordance with the above-noted Swiss Pat. No. 565,935, is tilted through a predetermined definite angle, whereby, the slats 1, which successively separate from the pack as toggle joints 8 stretch, are pivoted into a corresponding predetermined inclined position. The pivoting mechanism might also be designed to the effect that the slats are lowered in their horizontal, open position corresponding to that in which they are arranged in the pack. During lowering of the blind, carriage 19 remains in its extended position, as shown in FIG. 2.

As soon as the lower carriage part 19*b* arrives at its lowermost position in which the carriage is still extended as before, and all of the slats, as mentioned, occupy either the horizontal or a predetermined inclined position, depending on the setting of the pivoting mechanism, the slats can be brought into their closing position easily and in a simple manner without further lowering the blind or the lower carriage part, which applies through engaging member 28 to the lowermost slat.

The trip mechanism for pivoting the slats into their substantially vertical closing position is designed so analogously to the mentioned Swiss Pat. No. 565,935 that, with the further rotation of windup shaft 11, the mechanism is released, i.e., the pivotal balance beam is unlocked for being rotated with the shaft.

Figure 3:
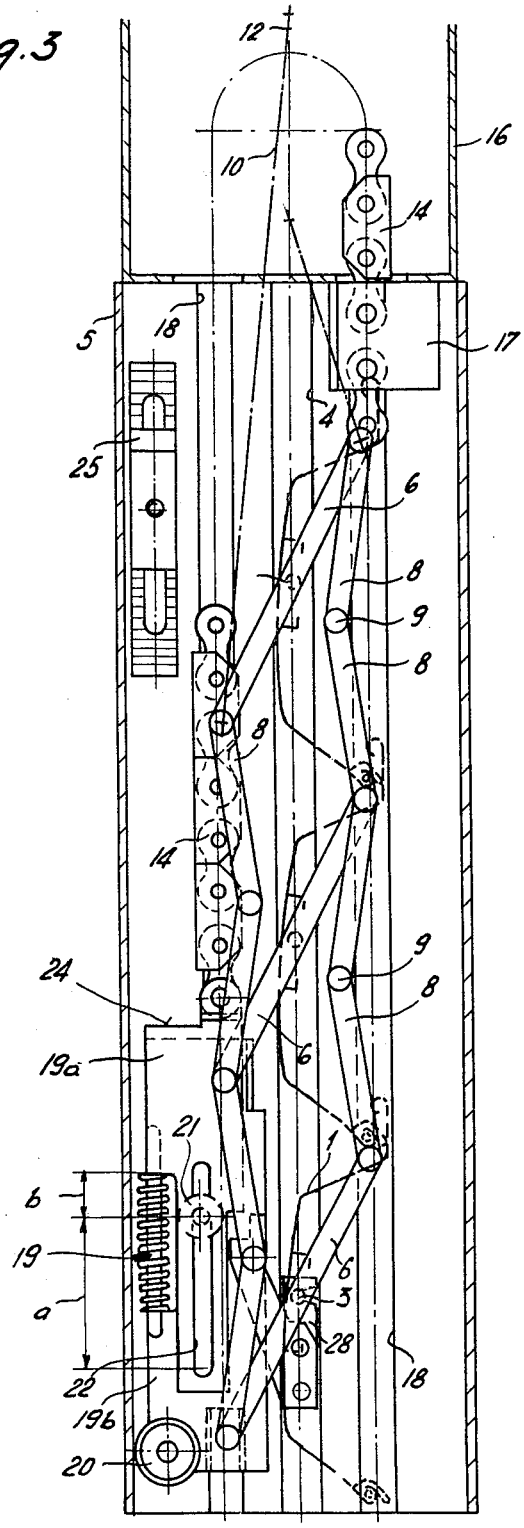
FIG. 3 is a view similar to FIG. 1 showing a fully lowered blind with the slats in their closing position.
Figure 4:
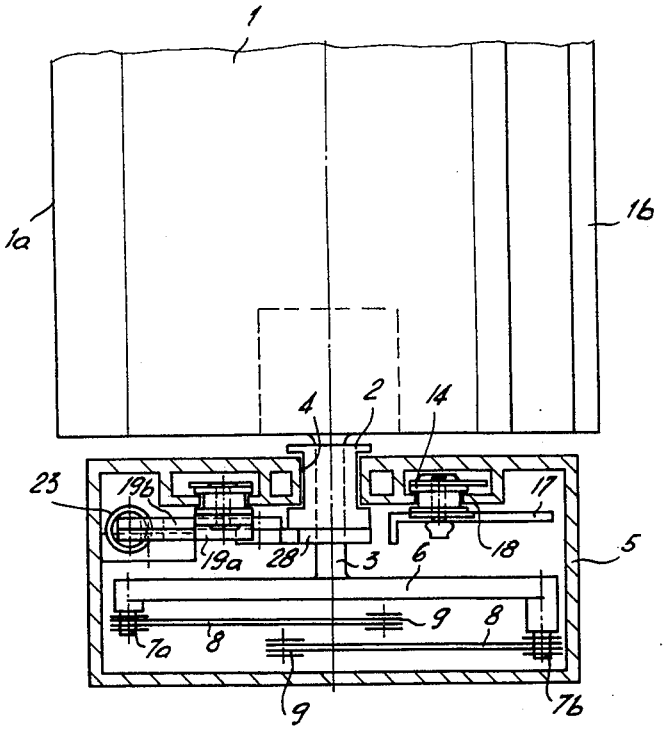
FIG. 4 is an enlarged horizontal, partly sectional view of the casing, with a partial top view of the blind.
Figure 6:
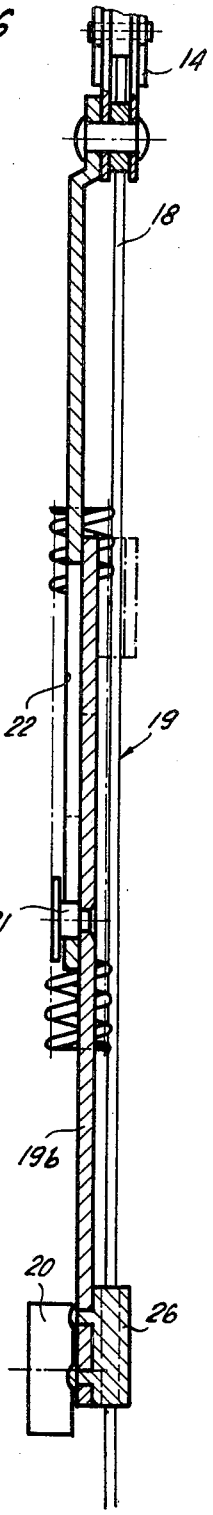
FIG. 6 is a sectional view taken along the line VI—VI of FIG. 5.
Figure 5:
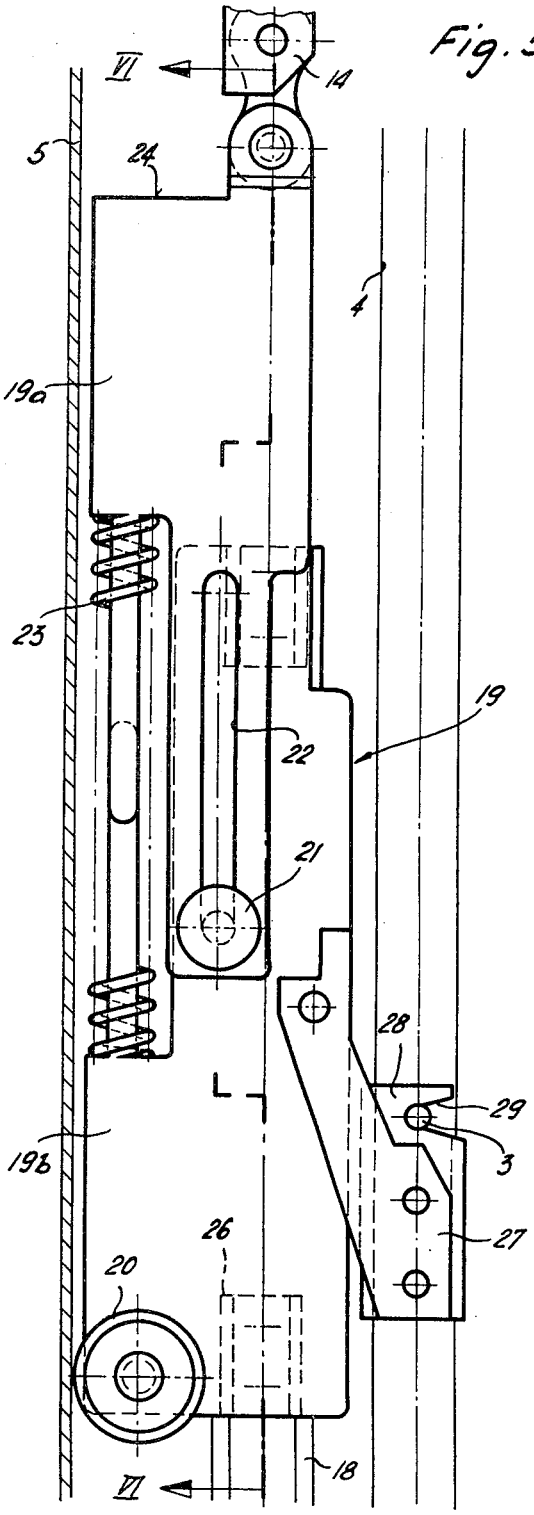
FIG. 5 is an enlarged view of the carriage of the blind, guided in the casing.

This further rotation of windup shaft 11, by which balance beam 12 is taken along, results in the pivoting of slats 1 into their substantially vertical closing position, shown in FIG. 3. In addition, further rotation of windup shaft 11 and, thereby, of sprocket wheel 13, causes a corresponding further travel of chain 14.

Since the chain is secured against flection by guide 18 and against radial disengagement from wheel 13 by guard 15, it acts as a rigid bar and pushes the upper carriage part 19*a* hinged thereto, downwardly, against the action of spring 23 and through a distance a, which is necessary for closing slats 1 (FIG. 3). The lower carriage part 19*b* cannot move downwardly, since its motion in this direction is limited, through supporting plate 27 and engaging member 28, by the lowermost slat 1 which, in turn, is held by the system of stretched toggle joints 8.

As shown in FIG. 3, the distance a necessary for closing slats 1 and through which the two carriage parts 19*a* and 19*b* move toward each other, is shorter than the total allowance given by the length of slot 22. The difference is indicated at b. This provides security against overtravel in instances where the windup shaft is driven mechanically, and compensates for time inaccuracies in stopping or disengaging the drive.

Slats 1 are brought into their open position by a reverse rotation of windup shaft 11 (clockwise in FIG. 1) during which, initially, chain 14 moves upper carriage part 19*a* away from lower carriage part 19*b*, through the distance a. Movement of lower carriage part 19*b* during this time is prevented by spring 23. Only after the two carriage parts 19*a* and 19*b* are completely moved apart, and the slats are pivoted back into their predetermined open position, which pivoting is associated therewith, lower carriage part 19*a* is also taken along and slats 1 are then brought into the horizontal or open position which they will occupy in the pack. Further rotation of windup shaft 11 results in a lifting of the blind while slats 1 are gathered and finally arrive at the upper end into their position shown in FIG. 1.

Due to the two-part carriage 19, which is expandable to a limited extent under the action of a spring, the inventive blind does not require any compensating spring in the draw member 14. Due to the relative short open chain 14 which can be flexed only toward the inside of casing 5 along the circumference of the single, i.e., upper, sprocket wheel, the blind is inexpensive. Since the customary mechanism provided between the windup shaft and the actuating element is self-locking, the spring 23 urging the carriage parts 19*a* and 19*b* apart, while slats 1 are in their closing position, is incapable of automatically moving the upper carriage part 19*a* and, consequently, chain 14 and balance beam 12, so as to effect pivoting of the slats into their open positions. Nor can this be effected manually by pushing the blind upwardly (burglary-proof design), since the chain section between carriage 19 and sprocket wheel 13 is prevented from flexing.

While a specific embodiment of the invention has been shown and described in detail to illustrate the application of the principles of the invention, it will be understood that the invention may be embodied otherwise without departing from such principles.

What is claimed is:

1. A venetian blind, comprising: a plurality of slats; a pin extending from at least one side of each of said slats; a casing having a longitudinally extending slot for receiving said pins to permit longitudinal movement of said slats; collapsible support means interconnecting said plurality of slats for pivoting said slats as said slats are moved to extend and retract said blind, and for defining a full extension of said slats; a driven windup shaft rotatably mounted with respect to said casing; a draw member engaged with said windup shaft and movable in said casing by rotation of said shaft to retract and extend said slats; an upper carriage part connected to one end of said draw member having a stop surface; an end stop on said casing against which said stop surface is abutable to stop movement of said draw member in one direction; a lower carriage part slidably connected to said upper carriage part and connected to a lowermost one of said slat pins; and spring means connected between said upper and lower carriage parts to bias said upper and lower carriage parts apart, whereby, additional motion of said draw member beyond the point where said slats are fully extended is taken up by said spring means.

2. A venetian blind, as claimed in claim 1, wherein said draw member comprises a chain which is flexible in only one direction, said driven windup shaft including a sprocket mounted thereon for receiving said chain, said chain being flexible around said sprocket only.

3. A venetian blind, as claimed in claim 2, including at least one additional end stop connected to said chain adjacent a free end thereof opposite the end of said chain which is connected to said upper carriage part.

4. A venetian blind, as claimed in claim 2, wherein said casing includes guiding slots for receiving said chain to prevent the flexing of said chain.

5. A venetian blind, as claimed in claim 2, wherein said casing includes a U-shaped guide disposed around said sprocket wheel for preventing radial disengagement of said chain from said sprocket.

6. A venetian blind, as claimed in claim 2, wherein said slats are fully extended but pivoted into an open position by said collapsible support means when said spring means holds said upper and lower carriage parts apart, and said slats are pivoted into a closed position when additional movement of said draw member compresses said spring means to move said upper and lower carriage parts together.

7. A venetian blind, as claimed in claim 2, wherein said casing includes a pair of guiding slots, said chain movable in each of said guiding slots to prevent flexing thereof, and said upper and lower carriage parts guided in one of said slots.

8. A venetian blind, as claimed in claim 1, wherein at least one of said upper and lower carriage parts includes a slot and the other of said upper and lower carriage parts includes a pin engaged into said slot, said spring means comprising a compression spring connected between said upper and lower carriage parts for biasing them apart.

9. A venetian blind, as claimed in claim 1, wherein said collapsible support means comprise a cross-lever connected to each of said pins, and toggle joints connected between respective ends of each of said cross-levers.

* * * * *

UNITED STATES PATENT AND TRADEMARK OFFICE

CERTIFICATE OF CORRECTION

PATENT NO. : 4,324,284

DATED : April 13, 1982

INVENTOR(S) : Paul Frei

It is certified that error appears in the above-identified patent and that said Letters Patent is hereby corrected as shown below:

On the title page add:

-- [30] Foreign Application Priority Data

Feb. 16, 1979 Switzerland 1529/79 --

Signed and Sealed this

Fourth Day of September 1984

[SEAL]

*Attest:*

GERALD J. MOSSINGHOFF

*Attesting Officer*

*Commissioner of Patents and Trademarks*